US009260938B2

(12) United States Patent
Holderman et al.

(10) Patent No.: US 9,260,938 B2
(45) Date of Patent: Feb. 16, 2016

(54) APPARATUS, SYSTEMS AND METHODS FOR BYPASSING A FLOW CONTROL DEVICE

(75) Inventors: Luke William Holderman, Plano, TX (US); David Smart, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 471 days.

(21) Appl. No.: 13/814,930

(22) PCT Filed: Apr. 18, 2012

(86) PCT No.: PCT/US2012/034010

§ 371 (c)(1), (2), (4) Date: Feb. 7, 2013

(87) PCT Pub. No.: WO2013/158085

PCT Pub. Date: Oct. 24, 2013

(65) Prior Publication Data

US 2013/0277059 A1 Oct. 24, 2013

(51) Int. Cl.

| | |
|---|---|
| ***E21B 34/08*** | (2006.01) |
| *E21B 34/06* | (2006.01) |
| *E21B 34/00* | (2006.01) |

(52) U.S. Cl.

CPC ..... *E21B 34/08* (2013.01); *E21B 34/063* (2013.01); *E21B 2034/007* (2013.01)

(58) Field of Classification Search

CPC ..... E21B 43/12; E21B 34/08; E21B 34/085; E21B 34/063; E21B 2034/007

See application file for complete search history.

(56) References Cited

U.S. PATENT DOCUMENTS

| | | | | |
|---|---|---|---|---|
| 3,130,747 | A * | 4/1964 | Benaway | 137/504 |
| 5,174,330 | A * | 12/1992 | Golestan et al. | 137/504 |
| 5,265,643 | A * | 11/1993 | Golestan et al. | 137/504 |
| 5,896,928 | A * | 4/1999 | Coon | 166/373 |
| 7,059,401 | B2 * | 6/2006 | Bode et al. | 166/51 |
| 7,296,624 | B2 * | 11/2007 | Rodet et al. | 166/278 |
| 7,296,633 | B2 * | 11/2007 | Bode et al. | 166/386 |
| 7,775,284 | B2 * | 8/2010 | Richards et al. | 166/329 |
| 7,857,061 | B2 * | 12/2010 | Richards | 166/373 |
| 8,356,669 | B2 * | 1/2013 | Holderman | 166/316 |

(Continued)

OTHER PUBLICATIONS

Holderman Luke, et al., PCT Application entitled "Apparatus, Systems and Methods for Bypassing a Flow Control Device", filed on Apr. 18, 2012, Int'l Application PCT/US2012/034010.

(Continued)

*Primary Examiner* — Blake Michener

(74) *Attorney, Agent, or Firm* — Scott Richardson; Baker Botts L.L.P.

(57) ABSTRACT

A bypass assembly for use in a downhole tool comprises a chamber, a first fluid port in fluid communication with the chamber, a second fluid port in fluid communication with the chamber, a flow restrictor disposed in a first flow path between the first fluid port and the second fluid port, a piston moveable in a first direction by the application of a first fluid pressure, a biasing member, and a restraining member disposed adjacent to the piston. The biasing member biases the piston to move in a second direction opposite the first direction, and the restraining member is actuated by movement of the piston in the first direction in response to a predetermined fluid pressure. Movement of the piston in the second direction to a predetermined position configures the bypass assembly to divert fluid flow around the flow restrictor along a second flow path.

19 Claims, 7 Drawing Sheets

(56) References Cited

U.S. PATENT DOCUMENTS

| | | | | |
|---|---|---|---|---|
| 8,474,535 | B2 * | 7/2013 | Richards et al. | 166/325 |
| 8,807,215 | B2 * | 8/2014 | Holderman et al. | 166/269 |
| 8,931,570 | B2 * | 1/2015 | Casciaro et al. | 166/386 |
| 2002/0108755 | A1 * | 8/2002 | Zisk, Jr. | 166/369 |
| 2008/0314590 | A1 | 12/2008 | Patel | |
| 2009/0084556 | A1 * | 4/2009 | Richards et al. | 166/329 |
| 2009/0151925 | A1 | 6/2009 | Richards et al. | |
| 2009/0277650 | A1 | 11/2009 | Casciaro et al. | |
| 2011/0030969 | A1 * | 2/2011 | Richards | 166/373 |
| 2011/0198097 | A1 * | 8/2011 | Moen | 166/373 |
| 2012/0048561 | A1 * | 3/2012 | Holderman | 166/316 |

OTHER PUBLICATIONS

Foreign Communication—International Search Report and Written Opinion, PCT/US2012/034010, dated Dec. 26, 2012.

* cited by examiner

APPARATUS, SYSTEMS AND METHODS FOR BYPASSING A FLOW CONTROL DEVICE

CROSS-REFERENCE TO RELATED APPLICATIONS

This application claims priority under 35 U.S.C. §371 and is a National stage of International Application No. PCT/US2012/034010, entitled "Apparatus, Systems and Methods for Bypassing a Flow Control Device", by Luke Holderman, et al., filed Apr. 18, 2012 in the United States Receiving Office, which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The disclosure relates generally to equipment utilized and operations performed in conjunction with a subterranean well and, more particularly, to the application of flow control devices to manage fluid flow into and out of a tubular body.

Without limiting the scope of the disclosure, its background will be described with reference to producing fluid from a hydrocarbon bearing subterranean formation, as an example.

During the production of hydrocarbons from a subterranean well, it was desirable to substantially reduce or exclude the production of water produced from the well. For example, it is desirable for the fluid produced from the well to have a relatively high proportion of hydrocarbons, and a relatively low proportion of water. In some cases, it is also desirable to restrict the production of hydrocarbon gas from a well.

In addition, where fluid is produced from a long interval of a formation penetrated by a wellbore, it is known that balancing the production of fluid along the interval can lead to reduced water and gas "coning," and more controlled conformance, thereby increasing the proportion and overall quantity of oil produced from the interval. Inflow control devices (ICDs) have been used in the past to restrict flow of produced fluid through the ICDs for this purpose of balancing production along an interval. For example, in a long horizontal wellbore, fluid flow near the "heel" of the wellbore may be more restricted as compared to fluid flow near a "toe" of the wellbore, to counteract a horizontal well's tendency to produce at a higher flow rate at the "heel" of the well as compared to the "toe."

SUMMARY

In an embodiment, a bypass assembly for use in a downhole tool comprises a chamber, a first fluid port in fluid communication with the chamber, a second fluid port in fluid communication with the chamber, a flow restrictor disposed in a first flow path between the first fluid port and the second fluid port, a piston moveable in a first direction by the application of a first fluid pressure, a biasing member, and a restraining member disposed adjacent to the piston. The biasing member biases the piston to move in a second direction opposite the first direction, and the restraining member is actuated by movement of the piston in the first direction in response to a predetermined fluid pressure. Movement of the piston in the second direction to a predetermined position configures the bypass assembly to divert fluid flow around the flow restrictor along a second flow path.

In an embodiment, a flow control device for use in a downhole tool comprises a flow restriction disposed in a first flow path between a first port and a second port, and a bypass mechanism configured to be moveable between a first position and a second position in response to a first pressure. The first flow path between the first port and the second port is established when the bypass mechanism is in the first position, and a second flow path between the first port and second port is established when the bypass mechanism is in the second position.

In an embodiment, a method for bypassing a flow restrictor comprises flowing a fluid through a first flow path between a first port and a second port, where the first flow path comprises a flow restrictor, translating a moveable element in response to a pressure applied to the moveable element, where the translating the moveable element opens a second flow path between the first port and the second port, and flowing a fluid through the second flow path.

These and other features and characteristics will be more clearly understood from the following detailed description taken in conjunction with the accompanying drawings and claims.

BRIEF DESCRIPTION OF THE DRAWINGS

For a detailed description of the apparatus, systems and methods disclosed herein, reference will now be made to the accompanying drawings in which.

DETAILED DESCRIPTION

It should be understood at the outset that although illustrative implementations of one or more embodiments are disclosed herein, the disclosed apparatus, systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Certain terms are used throughout the following description and claims to refer to particular features or components. The drawings are not necessarily to scale. Certain features and components herein may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "uphole" meaning toward the surface of the wellbore and with "down," "lower," "downward," or "downhole" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Figure 1:
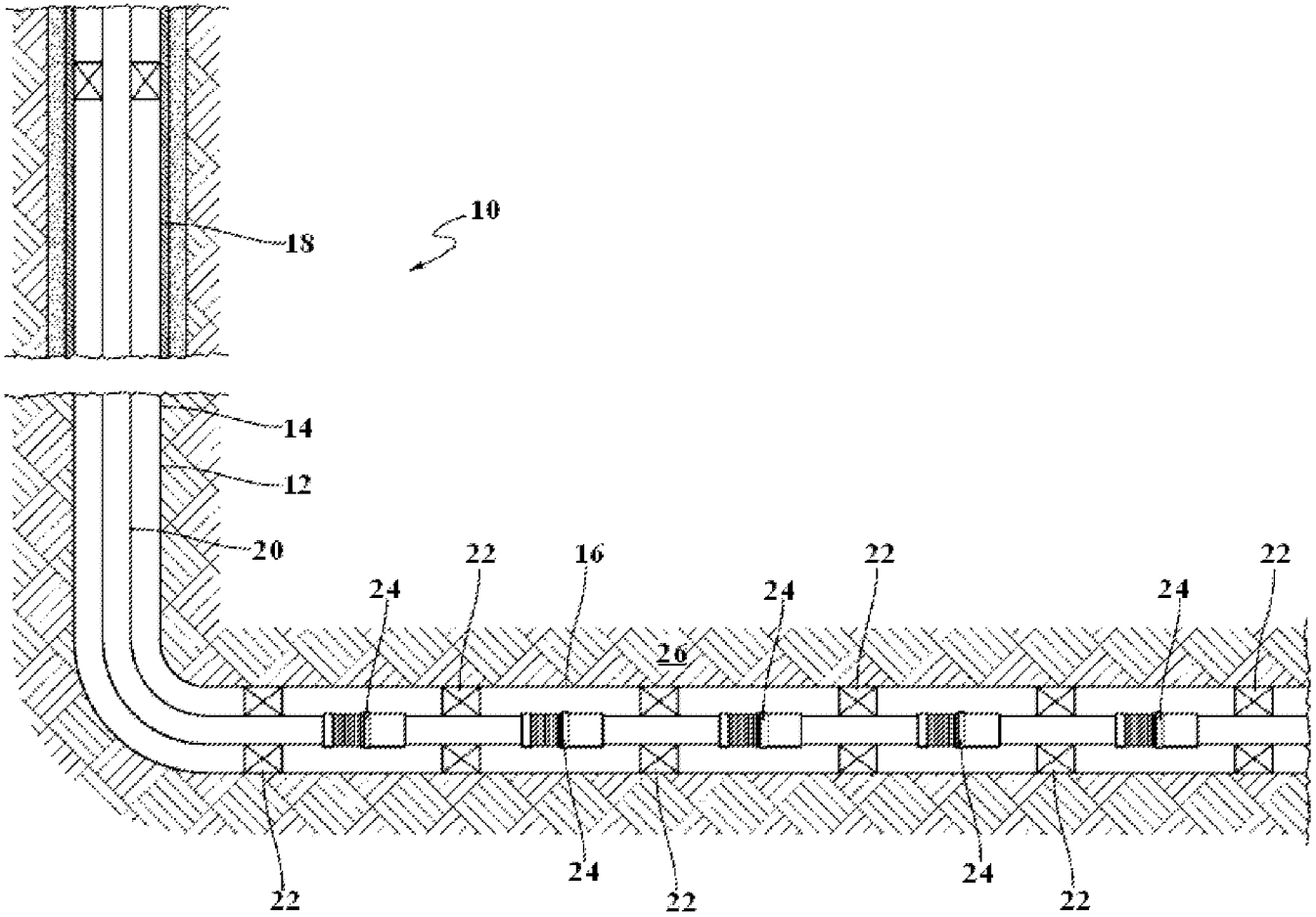
FIG. 1 is a schematic illustration of a well system including a plurality of flow control devices.

Referring initially to FIG. 1, therein is depicted an exemplary well system 10 comprising a wellbore 12 with both a substantially vertical section 14 and a substantially horizontal section 16, casing 18, tubular string 20, plurality of spaced apart packers 22 and flow control devices 24, and a formation 26.

Production of hydrocarbons may be accomplished by flowing fluid containing hydrocarbons from the formation 26, into horizontal section 16 and into the tubular string 20 through the plurality of flow control devices 24. In this example, the flow control devices 24 provide for the filtering of unwanted material from the formation 26 and for the metering of fluid input from the formation into the tubular string 20. Packers 22 can isolate each individual flow control device 24 into different zones or intervals along the wellbore 12 by providing a seal between the outer wall of the wellbore 12 and tubular string 20.

Frictional effects of the fluid flow through the tubular string 20 may result in increased fluid pressure loss in the uphole section of the tubular string 20 disposed in the horizontal section 16. This pressure loss results in an increased pressure differential between the uphole sections of the tubular string 20 disposed in the horizontal section 16 and the formation 26, which in turn results in a higher flow rate into the uphole section of the tubular string 20. Thus, isolating each fluid control device 24 allows for the tailoring of the metering capability of each fluid control device 24 to result in a more even flow rate into each section of the tubular string 20. For instance, the uphole flow control devices 24 could include larger flow restrictions to act against the larger differential pressure forcing fluid into the flow control devices.

Although FIG. 1 depicts the flow control devices 24 in an open and uncased horizontal section 16, it is to be understood that the flow control devices are equally suited for use in cased wellbores. For instance, the flow control devices 24 and packers 22 may be used for flow control purposes when injecting treatment chemicals, such as acids, into the perforations of a cased wellbore. Further, although FIG. 1 depicts single flow control devices 24 as being isolated by the packers 22, it is to be understood that any number of flow control devices 24 may be grouped together and isolated by the packers 22, without departing from the principles of the present disclosure. In addition, even though FIG. 1 depicts the flow control devices 24 in a horizontal section 16, it is also to be understood that the flow control devices are equally suited for use in wellbores having other directional configurations including vertical wellbores, deviated wellbores, slanted wellbores, multilateral wellbores and the like.

After the onset of water or gas production in the well due to coning, it is sometimes desirable to reduce any flow restrictions created by the ICDs in order to maximize production. Thus, while ICDs may be desirable for delaying the point when water or gas production begins, higher flow rates into the well may be needed after this point in time in order to extract any remaining hydrocarbons from the surrounding formation. Accordingly, an apparatus and method are disclosed herein for quickly and efficiently bypassing the ICDs after they have been installed downhole in the well without the need for physically intervening into the well.

While a number of mechanisms may be used, it will be appreciated that a flow control device may comprise a bypass assembly for use in a downhole tool that may be used to bypass a flow restriction such as an ICD. The bypass assembly may comprise a moveable element that may be configured to move in response to the application of a first fluid pressure inputted from the second port. The bypass assembly may also comprise a restraining member configured to restrain the moveable element from actuating until a predetermined fluid pressure above a threshold is applied to the moveable element. The movement of the piston to a predetermined position may divert fluid flow around the flow restriction along a second flow path, thereby allowing for the flow restriction to be bypassed without requiring a mechanical intervention in the well. In an embodiment, the second flow path may have a smaller pressure drop in a fluid flow between the first port and the second port. Thus the bypass assembly may be configured to allow fluid to be produced along a first flow path, translate a moveable element in response to a fluid pressure, and thereafter produce the fluid along a second flow path. Similarly, the bypass assembly may be configured to produce a fluid with a first pressure drop, translate a moveable element in response to a fluid pressure, and thereafter produce the fluid with a second pressure drop that is different than the first pressure drop.

In an embodiment, a plurality of the flow control devices comprising bypass assemblies may be used with a plurality of flow restrictions disposed in a wellbore. In this embodiment, one or more of the bypass assemblies may be configured to actuate a moveable element in response to the application of a first pressure above a threshold. The one or more bypass assemblies may be configured to translate a moveable element and prevent fluid flow through the bypass assembly while the first pressure is maintained. This may allow all of the bypass assemblies to be actuated along the length of a wellbore until the pressure is thereafter reduced and the bypass assemblies are reconfigured to divert the fluid flow around the flow restriction along a second flow path. While only a portion of the bypass assemblies may actuate in response to the first pressure above a threshold, one or more additional bypass assemblies may be actuated in response to a second pressure above a threshold, where the second pressure is greater than the first pressure.

Figure 2A:
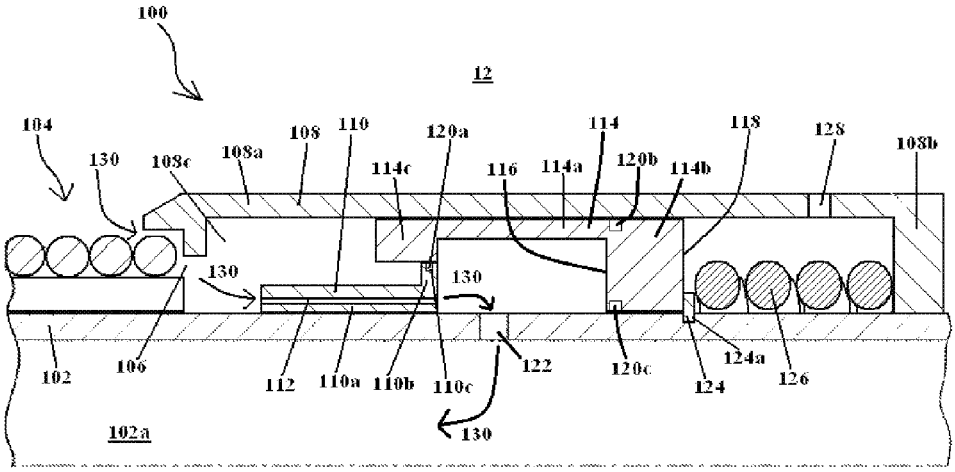
FIG. 2A is a cross-sectional view of an embodiment of a flow control device in a first position.

Referring now to FIG. 2A, therein is depicted a cross-sectional view of an embodiment of a flow control device 100 suitable for use as flow control device 24 previously described with reference to FIG. 1. Flow control device 100 generally includes a pipe or tubular member 102, a filter 104, a first port 106, a housing 108, a flow restrictor 110 with a fluid passage 112, a piston 114 with a first side 116 and a second side 118, a shear member 124, and a biasing member 126.

The tubular member 102 comprises any tubular member capable of being used downhole and communicating fluid at high pressures. The tubular member 102 forms a portion of the tubular string 20 described above with reference to FIG. 1 that can be bypassed. The tubular member 102 includes an internal fluid passageway 102*a*, through which fluids may be conveyed in both uphole and downhole directions, and at least one radially directed second port 122 that extends through the wall of the tubular member 102.

The housing 108 comprises an annular member disposed about the tubular member 102 forming annular chamber 108*c*, and includes a cylindrical outer portion 108*a* and a flanged portion 108*b* extending radially therefrom and fixed to the outer surface of the tubular member 102. Together, the outer portion 108*a* and the flange 108*b* define a chamber 108*c* between the housing 108 and the tubular member 102. A third port 128 provides for fluid communication between the wellbore 12 and the chamber 108*c*. Opposite flange 108*b* and adjacent to filter 104 is internal flange 108*d* that extends radially into chamber 108*c* from outer portion 108*a* and, as described in more detail below, defines a portion of the first port 106.

The flow restrictor 110 is an annular member that is disposed about the tubular member 102. In this embodiment, the restrictor 110 has an elongated tubular portion 110*a* and a flanged portion 110*b* that extends radially from tubular portion 110*a*. The portion 110*a* is fixed to the tubular member 102. The radially outermost surface of the flanged portion 110*b* includes a groove 110*c* in which an annular seal 120*a* is retained. Also in this embodiment of the flow restrictor 110, at least one fluid passage 112 extends in an axial direction through tubular portion 110*a*.

The piston 114 is another member disposed about the tubular member 102 and adapted for sliding engagement relative to the housing 108 and the tubular member 102. The piston 114 includes an elongated outer portion 114*a*, a lower flanged portion 114*b*, and an upper flanged portion 114*c* opposite the lower flanged portion. The lower flanged portion 114*b* extends inwardly from the outer portion 114*a* and retains annular seals 120*b* and 120*c*, which sealingly engage the inner surface of the housing 108 and outer surface of the tubular member 102, respectively. The lower flanged portion 106*b* also includes a first side 116 disposed adjacent to the second port 122 and a second side 118 disposed adjacent to the shear member 124. The upper flanged portion 114*c* includes an inwardly facing sealing surface for sealingly engagement with the seal 120*a* retained in the groove 110*c* of the flow restrictor 110. The annular seals 120*b* and 120*c* divide the chamber 108*c* into two portions, with one portion containing the first port 106, flow restrictor 110, second port 122 and first side 116 of the piston, and the other containing the shear member 124, biasing member 126, and third port 128.

In this embodiment, the shear member 124 is a pin disposed in the chamber 108*c* and extending into the wall of the tubular member 102. Shear member 124 is positioned in between the second side 118 of the piston 114 and the biasing member 126. The longitudinal axis of the shear member 124 is perpendicular to the longitudinal axis of the tubular member 102. Further, the shear member 124 is fixed within a bore 124*a* in the tubular member 102.

Figure 2B:
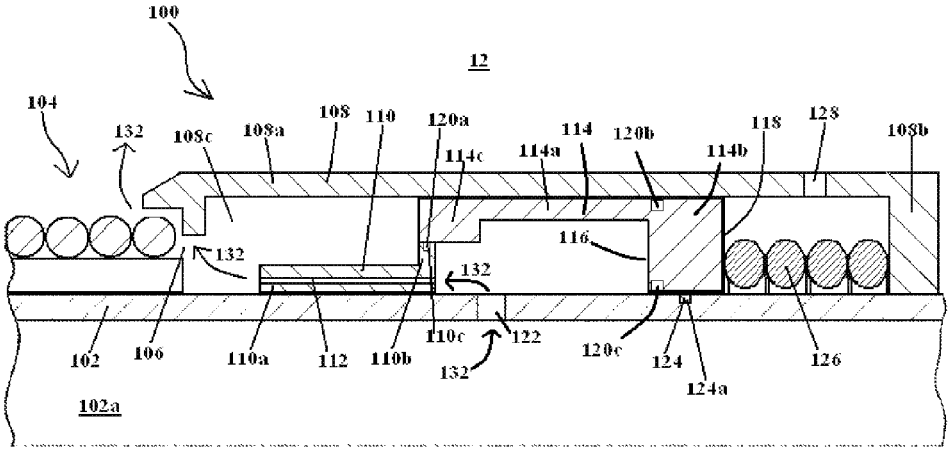
FIG. 2B is a cross-sectional view of an embodiment of a flow control device in a second position.

The biasing member 126 may comprise a compression spring disposed about the tubular member 102 in the chamber 108*c* and is initially restrained from movement in a compressed state by shear member 124. Furthermore, the biasing member 126 produces a biasing force against the shear member 124. The shearing member 124 and the biasing member 126 are designed such that the shearing member can withstand the biasing force without shearing. Also, although FIG. 2B depicts the biasing member 126 to be a spring, any suitable biasing mechanism may be used to provide a force to the piston 114 as described herein, such as disc springs, torsion springs, gas springs, elastomeric members and the like.

During normal operation when producing hydrocarbons via a well system, the pressure within tubular member 102 will be lower than the pressure of fluid within a surrounding formation 26. At this time, the piston 114 is disposed in a first position shown in FIG. 2A where the second side 118 acts on the shear member 124 and the upper flanged portion 114*c* is sealingly engaged with the seal 120*a* of the flow restrictor 110. In this configuration, due to this differential pressure, a flow path 130 is established where fluid from a surrounding formation enters the filter 104 in order to remove at least a portion of any entrained sand or other debris and particulates. The filter 104 illustrated in FIG. 2A is a type known as "wire-wrapped," where wire is closely wrapped helically about tubular member 102, with the spacing between each windings of wire designed to allow the passing of fluid but not of sand or other debris larger than a certain size. Other types of filters may also be used, such as sintered, mesh, prepacked, expandable, slotted, perforated and the like.

Following filtration, fluid enters the flow control device 100 through first port 106 and then passes through fluid passage 112 of flow restrictor 110, which creates a pressure drop between fluid entering the flow restrictor and fluid exiting the flow restrictor. The fluid passing along flow path 130 is prevented from flowing around or bypassing the flow restrictor 110 due to the seal 120*a* located on the flow restrictor which seals the engaging surfaces of the flow restrictor 110 and the piston 114. Having exited the flow restrictor 110, the fluid then follows flow path 130 through second port 122 and into the tubular member 102. The fluid in flow path 130 is prevented from lowing around the piston 114 and out of the third port 128 by the annular seals 120*b*, 120*c* disposed on the piston and sealingly engaging surfaces between the piston 114 and the housing 108 and between the piston and the tubular member 102.

In this particular embodiment, the flow restrictor 110 is a cylindrical flow tube with at least one through passage 112 extending generally parallel to its longitudinal axis and having a diameter that is substantially smaller than the axial length of the flow restrictor 110. This long, slender bore of the fluid passage 112 produces a flow restriction resulting in a pressure drop in the fluid flowing through it. Also, the diameter and length of this fluid passage 112 may be adjusted prior to installation of the flow control device 100 in order to achieve the desired amount of flow restriction. Although FIG. 2A illustrates a flow control device 100 with a flow tube type flow restrictor 110, other flow restrictor designs, such as described below, may be used in conformance with the principles set forth in this disclosure.

Referring again to FIG. 1, at a certain time during the production of hydrocarbons, it may be advantageous to bypass the flow restrictor 110 of the flow control device 100 in order to allow for a higher fluid flow rate to enter the tubular string 20 from a surrounding formation. For instance, a uniform flow rate for each individual flow control device 24 is often initially desired in order to delay water or gas production into the tubular string 20 from the formation 26. Once a well system 10 has begun producing water or gas from the formation 26, the advantage of a uniform metered flow from flow control devices 24 is diminished, and instead, increased flow rates are desired in order to capture any remaining hydrocarbons left in the formation 26. Thus, a means for reducing flow restrictions within the flow control devices 24 then becomes desirable in order to increase the flow rate entering the tubular string 20 from the formation 26.

Referring now to FIG. 2B, the flow control device 100 is provided with a bypass mechanism configured to allow the flow control device to lessen the flow restrictions (and thereby increase fluid intake) by introducing a pressure signal into tubular member 102. More particularly, internal fluid passageway 102*a* of tubular member 102 may be pressurized such that the fluid pressure within the tubular member 102 is higher than the pressure of the fluid in the surrounding formation 26. This increase in pressure results in a flow of fluid along reverse flow path 132. Fluid in flow path 132 moves from the internal fluid passageway 102*a* into the chamber 108*c* through the second port 122 formed in tubular member 102. From there, fluid flows into the fluid passage 112 of flow restrictor 110. Following there, the fluid moving in flow path 132 exits chamber 108*c* by passing through filter 104 and entering the wellbore 12 (illustrated in FIG. 1).

However, due to the pressure drop created by the flow restrictor 110, the pressure of the fluid entering the flow restrictor 110 is higher than the pressure of the fluid exiting the flow restrictor. Thus, a pressure force from the fluid entering chamber 108*c* via the second port 122 is applied to the first side 116 of flanged portion 114*b* of the piston 114. This pressure forces the piston 114 to move in a first direction against the shear member 124, which shears at a predetermined force in response to the shearing force applied by the piston 114 created by pressurizing the fluid in tubular member 102. The shear member 124 may be configured to shear at a known applied force, such the amount of pressure needed to be applied to the fluid in the tubular member 102 may be calculated so an operator of the well system will know approximately what pressure must be applied to the tubular member 102 for the shearing member 124 to be sheared.

Upon shearing of the shear member 124, the piston 114 applies a force against the biasing member 126. The pressure force from the fluid entering second port 122 will counteract the biasing force produced by the biasing member 126, forcing the biasing member to compress. The fluid surrounding the biasing member 126 does not provide a pressure force in response to the axial movement of the piston 114 due to the third port 128, which allows it to escape into the wellbore 12.

Even though the shearing member 124 has been sheared and thus the piston may be allowed to move axially in the direction of the biasing member 126 (left-to-right as depicted in FIG. 2B), the seal 120*a* between the flow restrictor 110 and the piston 114 prevents against any fluid in the flow path 132 from deviating around the flow restrictor. Thus, there is no path of least resistance for the higher pressure fluid within the tubular member 102 to escape, forcing the shear members 124 in all of the flow control devices 100 disposed on the tubular member 102 to shear. This is to be distinguished from the conventional use of rupture disks in flow control devices used in a production string because, once the first rupture disk has burst in one of the flow control devices, fluid is allowed to bypass the flow restrictor, and thus a path of least resistance is provided for the higher pressure fluid, preventing bursting of the rupture disks in the other flow control devices disposed along a production string.

Figure 2C:
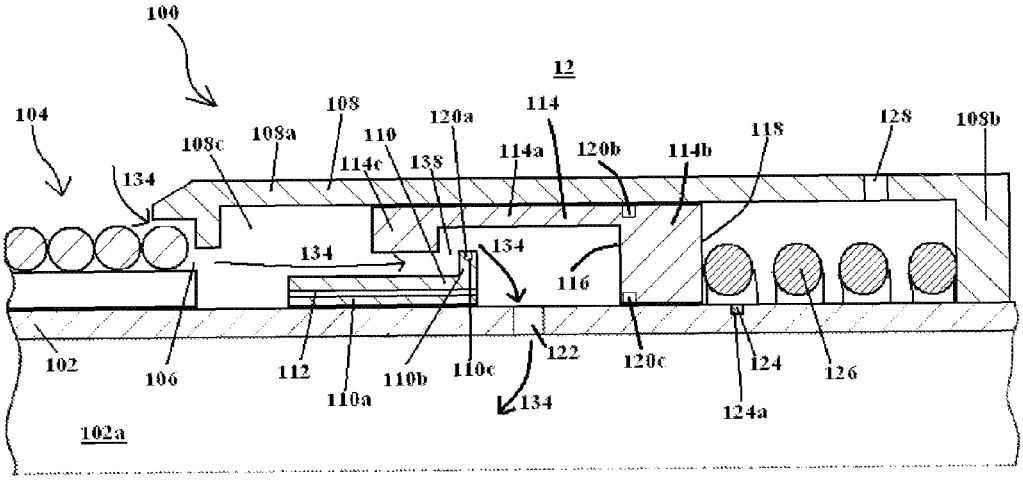
FIG. 2C is a cross-sectional view of an embodiment of a flow control device in a third position.

Referring now to FIG. 2C, following the shearing of the shear member 124 of the flow control device 100, an operator will reduce the pressure within the tubular member 102 until a pressure differential is created in which there is a higher pressure in the fluid of a formation 26 surrounding the flow control device 100 and a lower pressure in the tubular member 102. The reduced pressure in the tubular member 102 results in a reduction of pressure and thus a reduced force acting on the first side 116 of the piston 114. The reduced force acting on the first side 116 is offset by the biasing force produced by the biasing member 126. The larger biasing force acts on the second side 118 of the piston, forcing the piston to move axially in a second direction towards the flow restrictor 110, creating an annular gap 138 between the flow restrictor and the piston 114, as the piston comes to rest in a second position as shown in FIG. 2C.

Given the reduction in pressure of the fluid in the tubular member 102, a second flow path 134 results. Fluid passing along second flow path 134 first enters the filter 104 and flows into the flow control device 100 through the first port 106. Following this, the fluid in the flow path 134 flows around the flow restrictor 110, through gap 138 that is formed between the piston 114 and the flow restrictor 110. Then, the fluid in flow path 134 is directed through the second port 122 and into the internal fluid passageway 102*a* of tubular member 102. Allowing the flow path 134 to deviate around the flow restrictor 110 and, in this embodiment, to bypass the small diameter fluid passage 112, provides a path with a substantially larger cross-sectional area for fluid to flow through, providing for less restriction for the flow and a smaller pressure drop between the fluid entering the first port 106 and the fluid exiting the second port 122. Thus, by creating and employing a less restrictive flow path 134, a higher flow rate of fluid from formation 26 may be produced through the flow control device 100 as compared to the first flow path 130 of FIG. 2A.

To further illustrate various illustrative embodiments of systems, methods and tools for bypassing flow control devices, the following additional embodiments are provided.

Figure 3:
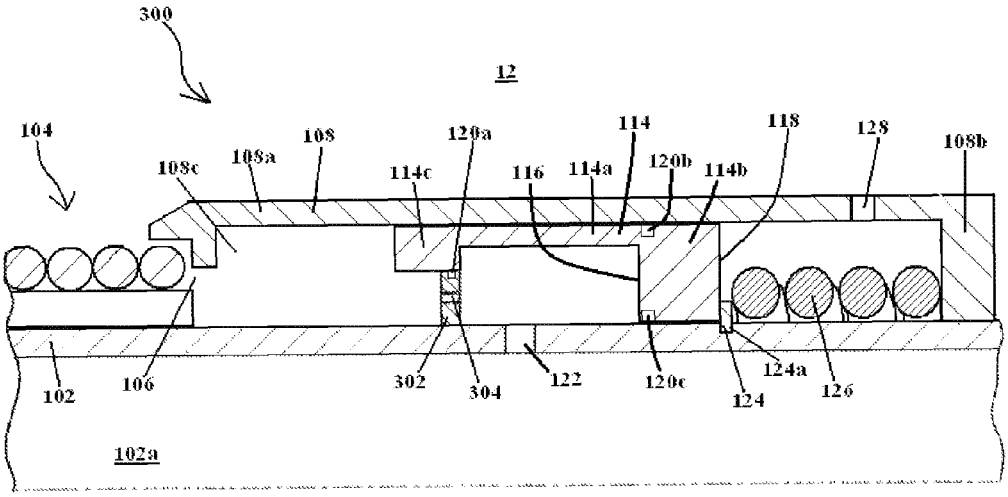
FIG. 3 is a cross-sectional view of an embodiment of a flow control device including a nozzle flow restrictor.

Referring to FIG. 3, in this embodiment of a flow control device 300, a nozzle 302 is fixed to the tubular member 102. The nozzle 302 includes a central orifice 304 for the creation of a pressure drop in a fluid flow passing through the nozzle 302. The seal 120*a* disposed in a groove of the nozzle 302 acts to create a seal between the upper flange 114*c* of the piston 114 and the nozzle 302. The operation of flow control device 300 is substantially the same as that described above with reference to flow control device 100.

Figure 4:
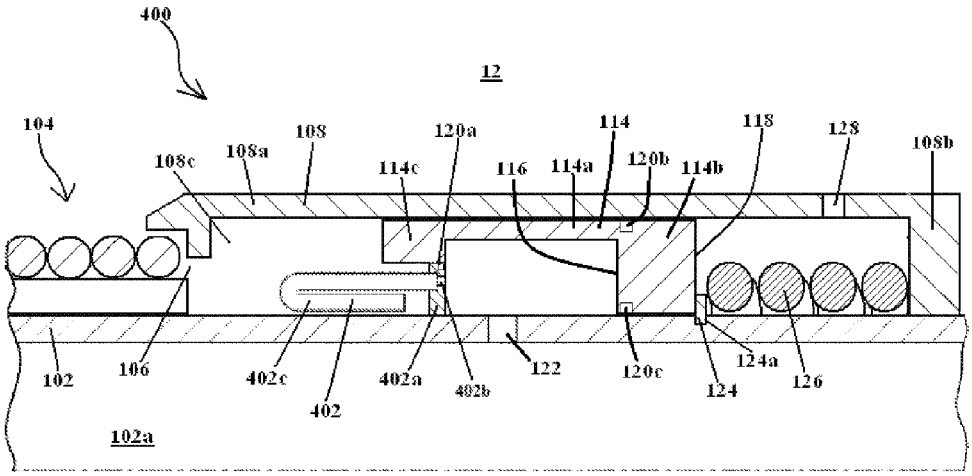
FIG. 4 is a cross-sectional view of an embodiment of a flow control device including a u-bend flow restrictor.

Referring to FIG. 4, in this embodiment of a flow control device 400, a U-Bend flow restrictor 402 is disposed about the tubular member 102. The U-Bend restrictor includes a flanged portion 402*a* that is fixed to the tubular member 102. The U-Bend restrictor 402 also includes a U-Bend portion 402*c* configured to induce a pressure drop in a fluid flowing through the U-Bend portion 402*c*. Both the U-Bend portion 402*c* and flanged portion 402*a* include a central through passage 402*b* for the passing of a fluid flow. The operation of flow control device 400 is substantially the same as that described above for flow control device 100.

Figure 5:
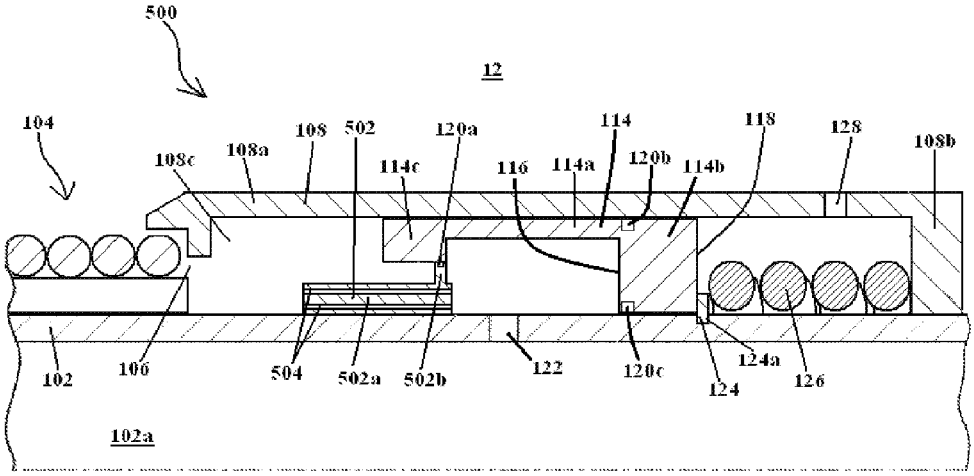
FIG. 5 is a cross-sectional view of an embodiment of a flow control device including an annular flow tube flow restrictor.

Referring to FIG. 5, in this embodiment of a flow control device 500, an annular flow tube 502 is fixed to the outer circumference of the tubular member 102. The annular tube 502 contains a solid cylindrical body 502*a* disposed within a tube 504. A fluid flow may be established in the annulus between the tube 504 and cylindrical body 502*a*, with the thin annulus resulting in a pressure drop in the fluid flow. The annular flow tube also contains a flanged portion 502*b* that retains the flow restrictor seal 120*a*. The flow restrictor seal 120*a* sealingly engages the upper flange 114*c*, forcing any fluid flow between the first port 106 and the second port 122 to flow through the annular flow tube 502. The operation of flow control device 500 is substantially the same as that described above for flow control device 100.

Figure 6:
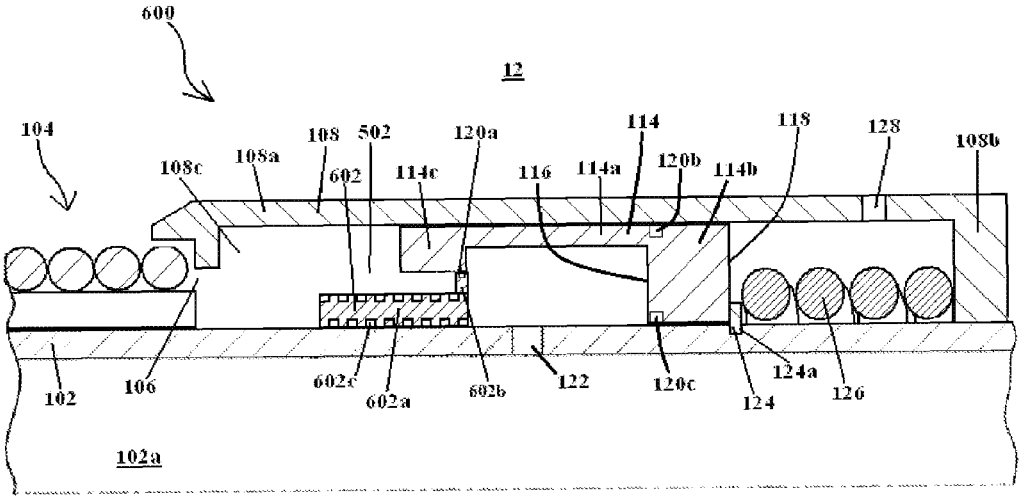
FIG. 6 is a cross-sectional view of an embodiment of a flow control device including a helical flow tube flow restrictor.

Referring to FIG. 6, in this embodiment of a flow control device 600, a helical flow tube 602 is fixed to the outer circumference of the tubular member 102. The helical flow tube 602 includes a cylinder 602*a* with a helical flow path 602*c* bored near the radial ends of the cylinder 602*a*. A fluid flow may be established through the helical flow path 602*c*, resulting in a pressure drop in the fluid as it flows through the helical flow tube 602. The helical flow tube 602 also includes a flanged portion 602*b* that houses the flow restrictor seal 120*a*, which sealingly engages the upper flange 114*c* of the piston 114, thus directing fluid through the helical flow tube 602. The operation of flow control device 600 is substantially the same as that described above for flow control device 100. Additional details concerning the flow restrictors 300, 400, 500 and 600 are disclosed in U.S. Patent Application No. 2009/0151925, the entire disclosure of which is incorporated herein by this reference.

With reference to FIGS. 2A-6, a shearing member 124 was described above that served as a restraining mechanism or releasable latch that prevents axial movement of piston 114 towards the biasing member 126 until a pressurization of predetermined magnitude caused the piston to shear the shearing member 124, thereby freeing the piston to be moved axially by means of the biasing member. Other releasable latches or restraining mechanisms can likewise be employed, including those that do not require the shearing of frangible members. For example, and referring now to FIG. 7A, another type of restraining mechanism is disclosed as employed in flow control device 700. More specifically, the restraining mechanism employed in flow control device 700 is a J-Slot mechanism. In this embodiment, an irregularly shaped J-Slot 702 is disposed within a top surface 136 of piston 114. A ring 704 is disposed within a slot in the wall 108*a* of housing 108 and about tubular member 102. Ring 704 is fixed axially by housing 108 but is free to rotate within housing 108 and about piston 114. Fixed to ring 704 is a radially-extending lug 706, disposed within a portion of slot 702. Lug 706 restricts the degree of rotation afforded ring 704 due to contact between lug 706 and the outer walls of slot 702.

Figure 7A:
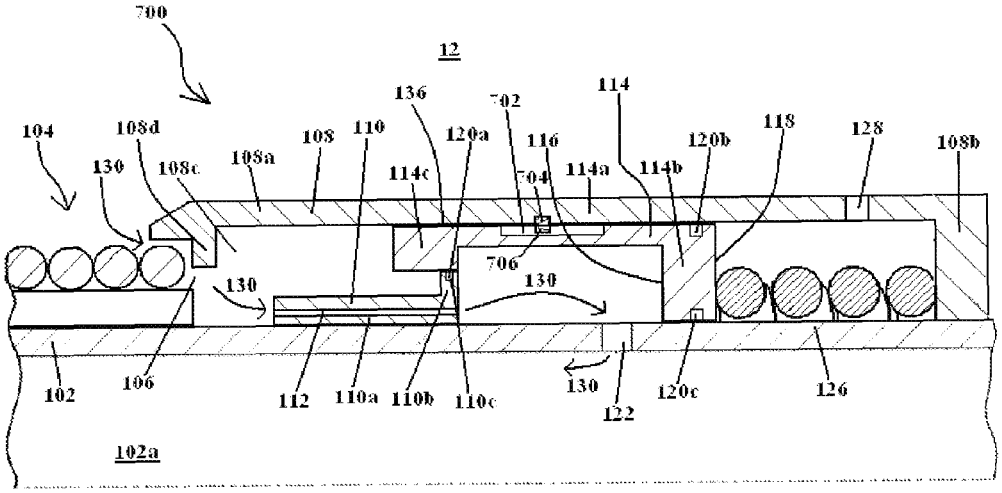
FIG. 7A is a cross-sectional view of an embodiment of a flow control device including a restraining member in the form of a J-Slot mechanism shown in a first position.
Figure 8:
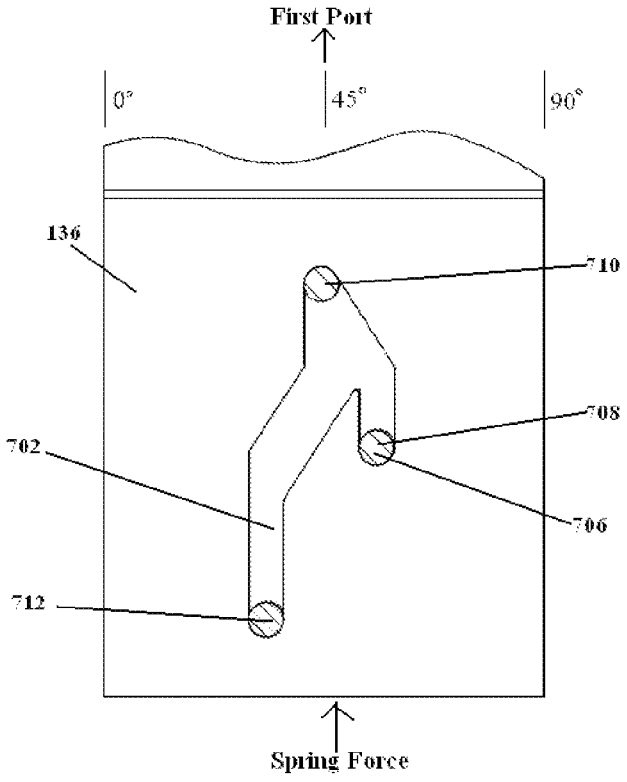
FIG. 8 is a top view of the J-Slot shown in FIGS. 7A-7C.
Figure 9:
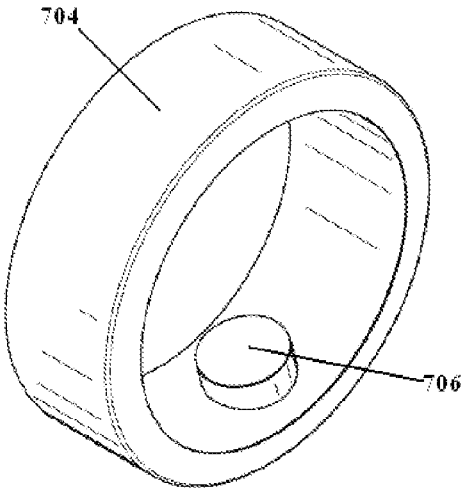
FIG. 9 is an isometric view of an embodiment of a lug ring for the J-Slot mechanism of FIGS. 7A-7C.

FIG. 8 illustrates the top surface 136 of piston 114. Disposed within the top surface 136 is the irregularly shaped J-Slot 702, and within slot 702 is disposed lug 706. Lug 706, depending on the position of piston 114, may translate between three different positions of slot 702: a first position 708, a second position 710, and a third position 712. FIG. 8 is shown oriented such that the bottom part of FIG. 8 is axially proximal to the biasing member 126 (FIG. 7A) and the top part of FIG. 8 is proximal to the first port 106 (FIG. 7A). FIG. 9 illustrates the shape of ring 704 and lug 706, as they are configured in the flow control device 700.

Referring to FIG. 7A, flow control device 700 is shown in a production state where an external pressure differential results in flow path 130, wherein fluid from wellbore 12 enters flow control device 100 through first port 106, flows through flow restrictor 110, and into internal fluid passageway 102*a* of tubular member 102 through second port 122. Piston 114 occupies a first position where second face 118 of piston is acted upon by biasing member 126. Biasing member 126 produces a force on piston 114 in the direction of first port 106. However, piston 114 is axially restrained from movement in the direction of first port 106 due to contact between lug 706 and slot 702. Referring to FIGS. 7A and 8, while piston 114 occupies this first position, lug 706 occupies first position 708 (FIG. 8), and is in contact with the outer wall of slot 702. Because lug 706 is fixed in the axial direction due to the disposition of ring 704 within a slot of housing wall 108*a*, the engagement of lug 706 in first position 708 with the outer wall of slot 702 prevents piston 114 from axial movement in the direction of first port 106.

Piston 114 in the first position, thus restrained from further axial movement in the direction of first port 106, provides a sealing engagement between upper flanged portion 114*c* and seal 120*a* of flow restrictor 110. This sealing engagement forces fluid along flow path 130 to flow through flow restrictor 110, creating a pressure drop, before entering second port 122.

Figure 7B:
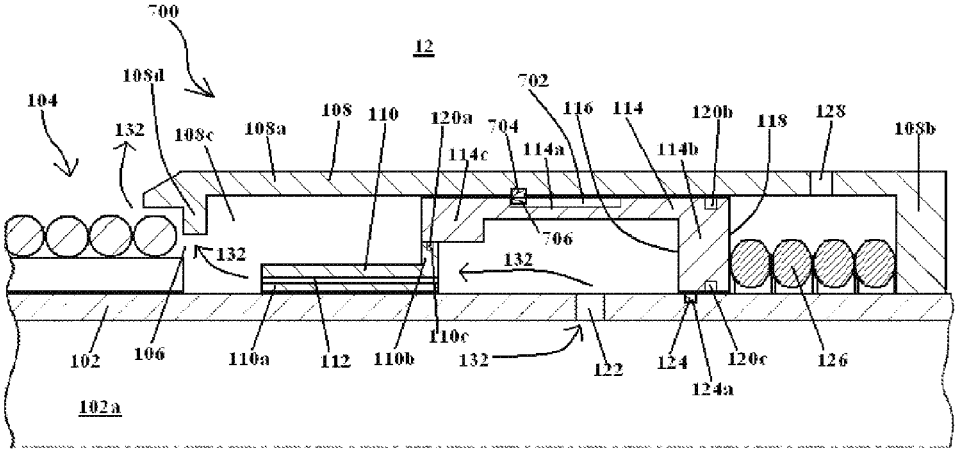
FIG. 7B is a cross-sectional view of the flow control device of FIG. 7A with the J-Slot mechanism shown in a second position.

Referring now to FIGS. 7B and 8, in order to move piston 114 into a second position, a well system operator pumps fluid at high pressure from the surface of the well system into internal fluid passageway 102*a*, creating an internal differential pressure where the pressure within internal fluid passageway 102*a* of tubular member 102 is higher than the pressure of fluid within the wellbore 12 surrounding tubular member 102. This internal pressure differential establishes flow path 132, where fluid enters chamber 108*c* through second port 122, providing a pressure force on first face 116 of piston 114. This pressure force, providing a larger force than the directionally-opposed force produced by biasing member 126, actuates the J-Slot 702 mechanism. The pressure force may be predetermined, in that the pressure within internal fluid passageway 102*a* necessary to provide for a pressure force on the first face 116 of piston 114 to defeat the biasing force created by biasing member 126 may be calculated.

Now forcibly compelled in the axial direction of biasing member 126, opposite the direction of first port 106, piston 114 is free to axially slide in the direction of biasing member 126 until lug 706 reaches its second position 710, shown by FIG. 8. After axial movement in the direction of biasing member 126 by piston 114, lug 706 comes into contact with the outer wall of slot 702 as it reaches second position 710, restraining piston 114 from further axial movement in the direction of biasing member 126. In this second position, upper flanged portion 114*c* of piston 114 remains in sealing engagement with seal 120*a* of flow restrictor 110.

Figure 7C:
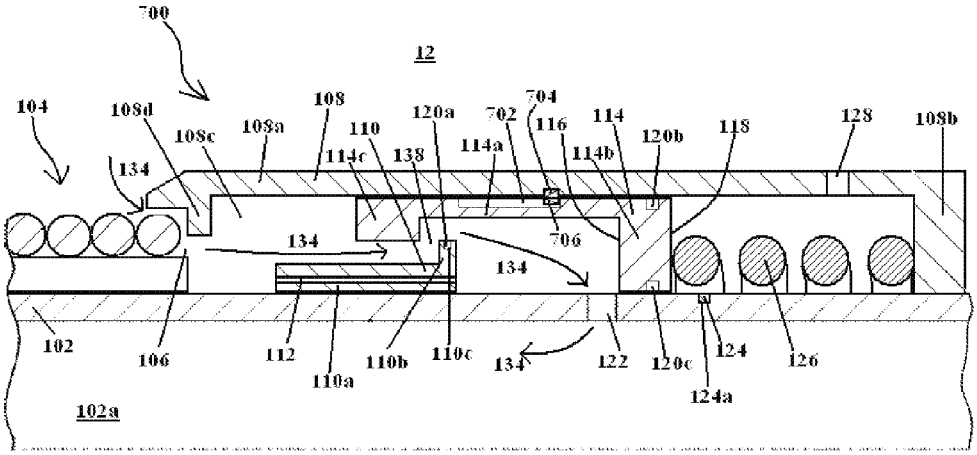
FIG. 7C is a cross-sectional view of the flow control device of FIG. 7A with the J-Slot mechanism shown in the third position.

Referring now to FIGS. 7C and 8, in order to move piston 114 into a third position, a well system operator reduces pressure within internal fluid passageway 102*a* of tubular member 102, creating an external differential pressure where the fluid within wellbore 12 has a higher pressure than fluid within internal fluid passageway 102*a*. The external differential pressure creates flow path 134, with fluid entering flow control device 700 through first port 106 and exiting into internal fluid passageway 102*a* through second port 122. Also, the external differential pressure actuates J-Slot 702, moving piston 114 into a third position shown in FIG. 7C.

While piston 114 is restrained from axial movement in the direction of biasing member 126 while lug 706 is in second position 710 (FIG. 8), piston 114 is free to slide axially in the direction of first port 106. The external pressure differential reduces the pressure force acting on first face 116 of piston 114, allowing the biasing member 126 to forcibly compel piston 114 in the direction of first port 106. With lug 706 in second position 710, piston 114 slides axially in the direction of first port 106, positioning lug 706 in third position 712 (FIG. 8), wherein the outer wall of slot 702 prevents piston 114 from any further axial movement in the direction of first port 106.

Now in a third position, upper flanged portion 114*c* is no longer in sealing engagement with seal 120*a* of flow restrictor 110, resulting in a gap 138. Fluid along flow path 134 may thus bypass flow restrictor 110, flow through gap 138, and enter internal fluid passageway 102*a* through second port 122. Bypassing flow restrictor 110 results in a second, smaller pressure drop of fluid in flow path 134 as it flows into internal fluid passageway 102*a* from wellbore 12. Further, instead of having ring 704 rotate, lug 706 may be fixed to housing 108 and the piston 114 may then rotate due to the interaction between lug 706 and the outer wall of slot 702.

In an embodiment, a method for bypassing a flow restrictor may comprise flowing a fluid through a first flow path from a first port to a second port, translating a component from a first position to a second position in response to a pressure differential, and flowing a fluid through a second flow path from the first port to the second port. The method may also include flowing a fluid through a third flow path from the second port to the first port, wherein the aforementioned pressure differential is created by the fluid flowing through the third flow path.

In an embodiment, another method for producing hydrocarbons from a well system may comprise flowing a fluid from a formation into an internal passageway of a production string. As the fluid enters the production string, it flows through a filter and an ICD to create a pressure drop in the fluid flow as it enters the internal passageway. After a period of producing fluid from the formation, fluid may be pumped into the production string from the surface, such as to create an internal pressure differential where the pressure within the internal passageway is higher than the pressure in the surrounding wellbore and formation. This internal pressure differential actuates a bypass of the flow restrictor disposed within each ICD in the production string. However, in another embodiment, this internal pressure differential may only actuate a portion of the ICDs in the production string. After at least a portion of the ICDs have been actuated, pressure within the internal passageway of the production string may be decreased, such as to create an external pressure differential where the pressure within the formation and wellbore is higher than the pressure within the internal passageway, causing flow into the internal passageway which may now bypass the ICD due to the actuation of the bypass mechanism. A fluid flow into the internal passageway from the formation may have a lower pressure drop due to bypassing the flow restrictor disposed within the ICD.

While specific embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A bypass assembly for use in a downhole tool comprising:

a chamber;

a first fluid port in fluid communication with the chamber;

a second fluid port in fluid communication with the chamber;

a flow restrictor disposed in a first flow path between the first fluid port and the second fluid port;

a piston disposed within the chamber and moveable in a first direction by the application of a first fluid pressure from the first fluid port;

a biasing member, wherein the biasing member biases the piston to move in a second direction opposite the first direction; and a restraining member disposed adjacent to the piston, wherein the restraining member is actuated by movement of the piston in the first direction in response to the first fluid pressure;

wherein the bypass assembly diverts fluid flow around the flow restrictor along a second flow path between the first fluid port and the second fluid port when the piston is actuated in the second direction to a second position.

2. The bypass assembly of claim 1, wherein the flow restrictor creates a first pressure drop in fluid flowing through the flow restrictor between the first port and the second port.

3. The bypass assembly of claim 2, wherein the flow restrictor and the piston are in sealing engagement and are configured to create the first pressure drop.

4. The bypass assembly of claim 2, wherein the movement of the piston to the predetermined position creates a second pressure drop in a fluid flow between the first port and the second port, and where the second pressure drop is less than the first pressure drop.

5. The bypass assembly of claim 2, wherein the first pressure drop is maintained during the movement of the piston in the first direction.

6. The bypass assembly of claim 1, wherein the piston is moveable in the second direction in response to a second, lower pressure applied from the second port.

7. A flow control device for use in a downhole tool comprising:

a flow restriction disposed in a first flow path between a first port and a second port;

a housing disposed about a tubular member and forming a chamber between the housing and the tubular member, wherein the tubular member comprises an interior passageway for conveying fluids, wherein the first port provides fluid communication between the interior passageway and the chamber and the second port provides fluid communication between the chamber and an exterior of the housing; and a piston disposed within the chamber and moveable between the first position and the second position, wherein the piston divides the chamber into a first portion and a second portion; and the piston forming a bypass mechanism configured to be moveable from the first position to the second position in response to a first pressure applied from the first port, wherein the first flow path is established when the bypass mechanism is in the first position, and wherein a second flow path between the first port and second port is established when the bypass mechanism is in the second position;

further comprising a biasing member disposed in the second portion of the chamber biasing the piston to move to the second position.

8. The flow control device of claim 7, wherein the flow restriction comprises a helical flow path.

9. The flow control device of claim 7, wherein the flow restriction comprises a nozzle.

10. The flow control device of claim 7, wherein the second flow path is less restrictive to fluid flow than the first flow path.

11. The flow control device of claim 7, wherein the bypass mechanism further comprises:

a restraining member disposed adjacent to the piston.

12. The flow control device of claim 11, wherein the restraining member is a shear member that is shearable at a predetermined pressure applied to a surface of the piston that is within the first portion of the chamber.

13. The flow control device of claim 12, wherein the biasing member biases the piston towards the second position.

14. The flow control device of claim 11, further comprising a third port providing a path for fluid to pass out of the second portion of the chamber when the piston compresses the biasing member.

15. The flow control device of claim 11, wherein the restraining member comprises a J-slot mechanism configured to release the piston for axial movement when a predetermined pressure is applied to the first portion of the chamber.

16. The flow control device of claim 7, wherein the piston is moveable to a third position that is displaced from the first position and the second position, and wherein the piston is sealed against the flow restriction while positioned in the third position.

17. A method for bypassing a flow restrictor comprising:

flowing a fluid through a first flow path between a first port and a second port, through a chamber defined between a housing disposed about a tubular member, wherein the first port provides fluid communication between an interior passageway of the tubular member and the chamber and the second port provides fluid communication between the chamber and an exterior of the housing, wherein the first flow path comprises a flow restrictor;

translating a moveable element in response to a pressure applied to the moveable element, wherein translating the moveable element opens a second flow path between the first port and the second port; and flowing a fluid through the second flow path and around the flow restrictor.

18. The method of claim 17, further comprising flowing a fluid through a third flow path between the second port and the first port.

19. The method of claim 18, wherein the pressure is created by the fluid flowing through the third flow path.

* * * * *